US010916858B2

(12) United States Patent
Spirtus et al.

(10) Patent No.: US 10,916,858 B2
(45) Date of Patent: Feb. 9, 2021

(54) SYSTEM, DEVICE AND METHOD FOR TUNING A REMOTE ANTENNA

(71) Applicant: NSL COMM LTD, Airport City (IL)

(72) Inventors: Daniel Spirtus, Holon (IL); Raz Itzhaki-Tamir, Rishon Le-Zion (IL); Daniel Rockberger, Ra'anana (IL)

(73) Assignee: NSL COMM LTD, Airport City (IL)

( * ) Notice: Subject to any disclaimer, the term of this patent is extended or adjusted under 35 U.S.C. 154(b) by 0 days.

(21) Appl. No.: 15/533,051

(22) PCT Filed: Dec. 3, 2015

(86) PCT No.: PCT/IL2015/051176
§ 371 (c)(1),
(2) Date: Jun. 5, 2017

(87) PCT Pub. No.: WO2016/088126
PCT Pub. Date: Jun. 9, 2016

(65) Prior Publication Data

US 2017/0365932 A1 Dec. 21, 2017

Related U.S. Application Data

(60) Provisional application No. 62/087,821, filed on Dec. 5, 2014.

(51) Int. Cl.
*H01Q 19/19* (2006.01)
*H01Q 15/14* (2006.01)
*H01Q 19/12* (2006.01)

(52) U.S. Cl.
CPC ..... *H01Q 15/147* (2013.01); *H01Q 15/145* (2013.01); *H01Q 19/12* (2013.01); *H01Q 19/192* (2013.01)

(58) Field of Classification Search
CPC ..... H01Q 15/147–20; H01Q 19/12; H01Q 19/192
(Continued)

(56) References Cited

U.S. PATENT DOCUMENTS 5,162,811 A 11/1992 Lammers et al.
5,374,939 A * 12/1994 Pullen, V ..... H01Q 3/18 126/573
(Continued)

FOREIGN PATENT DOCUMENTS

CN 102820544 A 12/2012
EP 0 219 321 4/1987
(Continued)

OTHER PUBLICATIONS

Search Report of International Application No. PCT/IL2015/051176 dated Mar. 13, 2016.
(Continued)

*Primary Examiner* — Hasan Z Islam
(74) *Attorney, Agent, or Firm* — Pearl Cohen Zedek Latzer Baratz LLP

(57) ABSTRACT

An antenna assembly tunable from remote comprising a main reflector a sub-reflector associated with the main reflector, and a feed adapted receive transmission illuminating the main reflector via the sub-reflector, or to transmit transmission to the main reflector via the sub-reflector. The sub-reflector comprising a plurality of actuators disposed over and attached to its outer face. Each of the actuators is adapted to locally deform the surface of the sub-reflector adjacent to that actuator in response to a change in the actuator position.

13 Claims, 10 Drawing Sheets

(58) Field of Classification Search
USPC ..... 343/834, 836, 839, 914, 915
See application file for complete search history.

(56) References Cited

U.S. PATENT DOCUMENTS

| | | | | |
|---|---|---|---|---|
| 5,440,320 | A | 8/1995 | Lach et al. | |
| 6,225,961 | B1 * | 5/2001 | Benjauthrit | H01Q 1/125 342/359 |
| 6,661,384 | B2 | 12/2003 | Mizuno | |
| 8,860,627 | B2 * | 10/2014 | Scolamiero | H01Q 15/147 343/880 |
| 9,203,156 | B2 * | 12/2015 | Yi | H01Q 15/147 |
| 2008/0309569 | A1 * | 12/2008 | Berejik | H01Q 1/185 343/761 |
| 2011/0115683 | A1 * | 5/2011 | Herrmann | G01R 29/10 343/760 |
| 2012/0092225 | A1 * | 4/2012 | Schreider | H01Q 15/147 343/834 |
| 2012/0229355 | A1 | 9/2012 | Scolamiero et al. | |
| 2013/0076590 | A1 * | 3/2013 | Baudasse | H01Q 3/01 343/915 |
| 2014/0266955 | A1 * | 9/2014 | Yi | H01Q 15/167 343/837 |
| 2014/0354501 | A1 * | 12/2014 | Schreider | H01Q 15/14 343/834 |
| 2015/0002357 | A1 * | 1/2015 | Sanford | H01Q 1/525 343/836 |

FOREIGN PATENT DOCUMENTS

| | | |
|---|---|---|
| FR | 2 952 759 | 5/2011 |
| JP | S60032411 | 2/1985 |

OTHER PUBLICATIONS

Lawson P R et al: "A piecewise deformable subreflector for compensaton of cassegrain main reflector errors", IEEE Transactions on Antennas and propagaion, IEEE Sercie Center, Piscataway, NJ, US, vol. 36, No. 10, Oct. 1, 1988, pp. 1343-1350, XP 00004231, ISSN: 0018-926X, DOI: 10.1109/8.8619 p. 1344-p. 1346.

Imbriale W A:"Distortion compensation techniques for large reflector antennas", Aerospace Conference, 2001, IEEE Proceedings. Mar. 10-17, 2001, Piscataway, MJ, USA, IEEE, Piscataway, NJ, USA, vol. 2, Mar. 20, 2001, pp. 799-805, XP010548304, ISBN: 978-0-7803-6599-5, p. 800.

European Search Report of EP Application No. 15 86 5828 dated Jun. 29, 2018.

Gregory Washington et al. "Design, Modeling and Optimization of Mechanically Reconfigurable Aperture Antennas" IEEE Transactions on Antennas and Propagation, vol. 50. No. 5, May 2002.

Office Action of EP Application No. EP15865828.6 dated Apr. 22, 2020.

Office Action of IN Application No. 201747022944 dated Feb. 25, 2020.

* cited by examiner

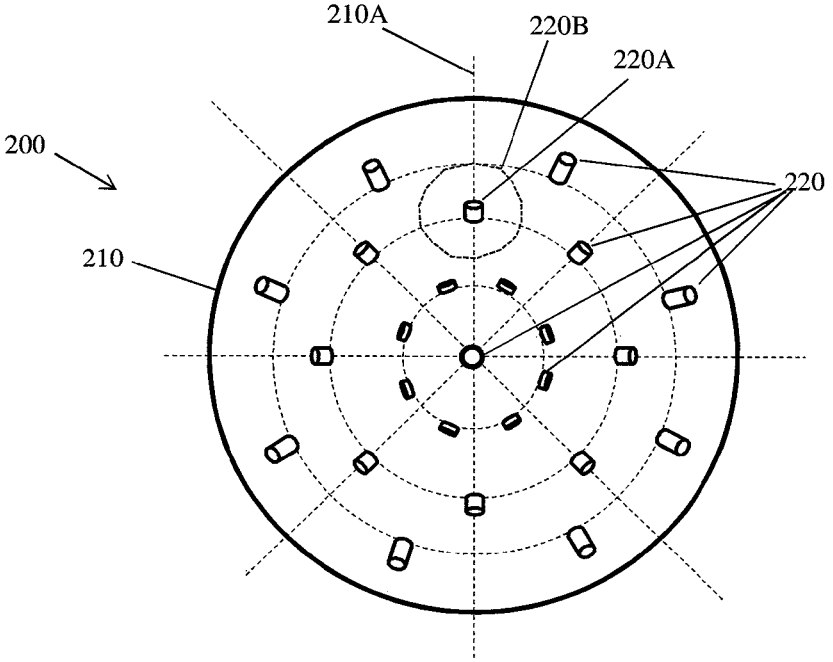
Fig. 2E
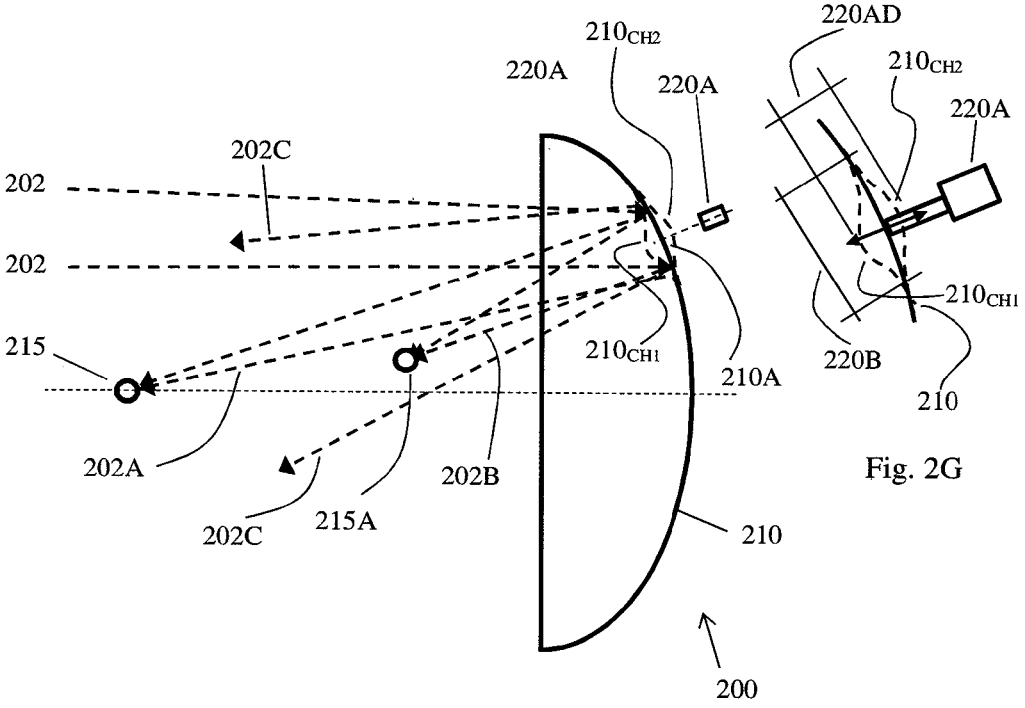
Fig. 2G
Fig. 2F

SYSTEM, DEVICE AND METHOD FOR TUNING A REMOTE ANTENNA

CROSS-REFERENCE TO RELATED APPLICATIONS

This application is a National Phase Application of PCT International Application No. PCT/IL2015/051176, International Filing Date Dec. 3, 2015, entitled System, Device and Method for Tuning a Remote Antenna and published as WO 2016/088126 on Jun. 9, 2016, claiming priority of U.S. Provisional Patent Application No. 62/087,821, filed Dec. 5, 2014 which is hereby incorporated by reference.

BACKGROUND OF THE INVENTION

Larger bandwidth for data communication while using antennas is an ever growing need. Due to the fact that antennas' dishes are many times limited in size due to deployment problems and logistics. For example when an antenna is deployed in space it is required to be folded to a predefined folded size in order to fit into the space craft out of which it would be deployed. One preferred solution for achieving larger size of the antenna is using deployable antenna reflectors. However, in many cases when folding or spreading antenna reflectors, and in some cases even when unhampered, those folded and then deployed reflectors are deformed and imperfect and hence cause issues such as incorrect antenna illumination footprints, degeneration of bandwidth etc.

Such issues require attention after the deployment of the antenna however in some cases the antenna is not easily or at all unreachable for calibration of the antenna and/or correcting of deployment defects.

Hence, improved systems and methods for improving the performance of deployed antennas is a long felt need.

SUMMARY OF THE INVENTION

An antenna assembly is presented, tunable from remote, comprising a main reflector, a sub-reflector associated with the main reflector, and a feed illuminating the main reflector via the sub-reflector, or to transmit transmission to the main reflector via the sub-reflector. The sub-reflector comprising a plurality of actuators disposed over and attached to its outer face, each of the plurality of actuators is adapted to locally deform the surface of the sub-reflector adjacent to that actuator in response to a change in the actuator position.

In some embodiments the plurality of actuators in the antenna assembly are disposed mutually evenly spaced over a selected area of the outer face of the sub-reflector.

In some additional embodiments each of the actuators in the antenna assembly is configured to change its position in response to a control signal.

In still further embodiment the antenna assembly further comprising a control unit. The control unit comprising a controller, a memory unit, a non-transitory storage unit and an input/output unit.

In some embodiments the antenna assembly further comprising a range detector located adjacent to the feed and adapted to scan and record values of distance from the range detector to selected points on the inner surface of the main reflector and to store these values in the non-transitory storage unit.

A sub-reflector for use in an antenna assembly is disclosed comprising a plurality of actuators disposed over and attached to its outer face, each of the plurality of actuators is adapted to locally deform the surface of the sub-reflector adjacent to that actuator in response to a change in the actuator position and a control unit adapted to control the position of each of the plurality of the actuators.

According to some embodiments the plurality of actuators are disposed in the sub-reflector mutually evenly spaced over a selected area of the outer face of the sub-reflector.

According to further embodiments the control unit of the sub-reflector comprising a controller, a memory unit, a non-transitory storage unit and an input/output unit.

According to yet further embodiments the non-transitory storage unit has stored thereon software program that when executed by the controller, causes the input/output unit to provide control signals to the actuators.

According to still further embodiments the sub-reflector further comprising a Reflector Imperfections Map (RIM) stored in the non-transitory storage unit.

According to yet further embodiment the plurality of actuators in the antenna assembly comprise a single actuator that is adapted to move the sub-reflector about a pivot point in angular movement in at least one of two perpendicular planes. The single actuator is further adapted to move the sub-reflector along a linear axis coinciding with the line of crossing of the two perpendicular planes closer to or farther from the main reflector. According to some embodiments the single actuator is further adapted to rotate the sub-reflector about the linear axis.

A method for tuning an antenna assembly is disclosed comprising a main reflector, a sub-reflector and a feed. The method comprising receiving initial deforms map of a main reflector, receiving at the main reflector steady transmission and recording the signal received at the feed, activating an actuator disposed on the outer surface of the sub-reflector and adapted to locally deform the curvature of the sub-reflector there until the signal received at the feed reaches a maximum value, holding the actuator and recording its stratus, repeating sequentially the previous step for each of the actuators disposed on the sub-reflector; and storing the values representing the status of the actuators in a storage in a set indicative of actuators status for maximum-of-maximum.

A method for tuning an antenna assembly is disclosed, the antenna assembly comprises a main reflector, a sub-reflector and a feed, the sub-reflector is provided with a plurality of actuators adapted to locally deform the curvature of the sub-reflector in response to an activation signal, the method comprising deploying a plurality of transmission sensors at a target area of the transmission illumination the antenna assembly, activating transmission from the antenna assembly, measuring and recording level of transmission power at each of the plurality of sensors along with the location of the respective sensor, extracting actual antenna assembly illumination footprint map from the recorded values, comparing the extracted illumination footprint map to a desired footprint, and providing activation signals to at least some of the actuators to deform the curvature of the sub-reflector so that the footprint of the illumination by the antenna assembly at the target area matches the desired footprint.

These, additional, and/or other aspects and/or advantages of the present invention are set forth in the detailed description which follows; possibly inferable from the detailed description; and/or learnable by practice of the present invention.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

FIG. 2E schematically illustrates deployment of a set of actuators on the backside of a sub-reflector 200, according to embodiments of the present invention;

FIGS. 2F and 2G schematically illustrate the operation of an actuator for causing local deformation in a sub-reflector, according to embodiments of the present invention;

Figure 1:
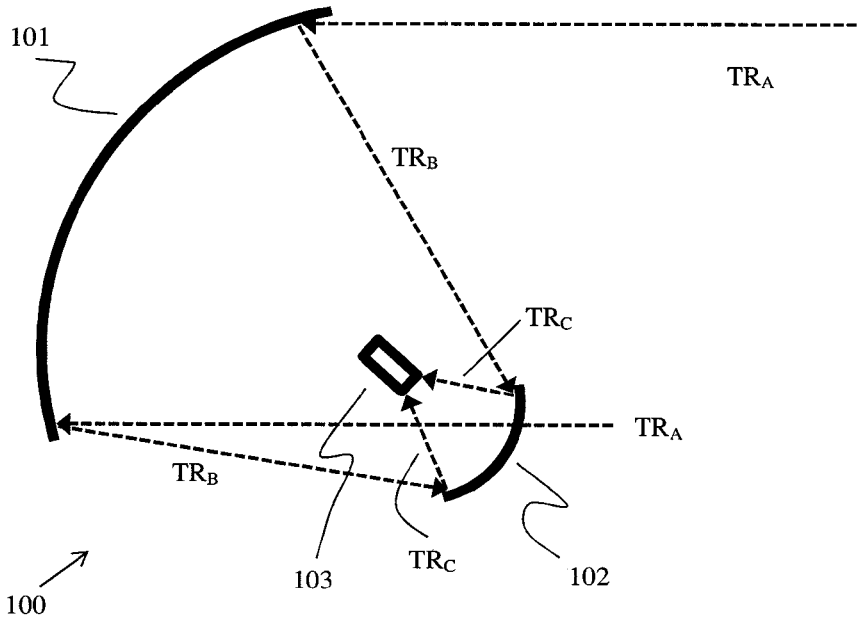
FIG. 1 illustrates the components of an antenna system.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. The term 'plurality' refers hereinafter to any positive integer (e.g, 1, 5, or 10).

The term 'footprint' refers hereinafter to the remote area that the antenna's transponders offer coverage of a target area (whether receiving or transmitting) wherein the signal strength received at or transmitted from the target area, respectively, is sufficient.

The term 'deformed' refers hereinafter to any defect, misalignment or not having the normal, natural or preferred shape or form.

The term "antenna assembly tuning" refers hereinafter to actions or measures taken with respect to an antenna in order to affect its performance, such as affecting or changing its gain, its operational bandwidth, its footprint, etc.

Although embodiments of the invention are not limited in this regard, discussions utilizing terms such as, for example, "processing," "computing," "calculating," "determining," "establishing", "analyzing", "checking", or the like, may refer to operation(s) and/or process(es) of a computer, a computing platform, a computing system, or other electronic computing device, that manipulates and/or transforms data represented as physical (e.g., electronic) quantities within the computer's registers and/or memories into other data similarly represented as physical quantities within the computer's registers and/or memories or other information non-transitory storage medium that may store instructions to perform operations and/or processes. The term set when used herein may include one or more items. Unless explicitly stated, the method embodiments described herein are not constrained to a particular order or sequence. Additionally, some of the described method embodiments or elements thereof can occur or be performed simultaneously, at the same point in time, or concurrently.

Usually, as depicted in FIG. 1, an antenna assembly 100 may comprise main reflector 101 and a feed assembly. Feed assembly may further comprise sub-reflector 102 and feed element 103. Receiving of transmission signals (schematically depicted by transmission propagation lines in the drawings and also denoted transmission lines) from a remote location, typically parallel radiation lines such as lines $TR_A$, require that main reflector 101 would concentrate the transmissions transmitted toward main reflector. The main reflector 101 will reflect the impinging transmissions (transmission lines $TR_B$) and focus them towards sub-reflector 102 so it will illuminate sub-reflector 102. Sub-reflector 102 in turn will reflect these transmissions (transmission lines $TR_C$) and will focus them even further towards feed element 103. Similar is performed when the antenna is transmitting. Feed element 103 radiates transmission beam towards sub-reflector 102, which in turn reflects the signals in a wider beam towards main reflector 101 which in turn reflects and focuses the signals (theoretically nearly in parallel transmission lines) towards a remote location.

In many cases, the main reflector in an antenna assembly need to be deployed on-site since due to its size and the available transporting means it needs to be folded when transported to the installation site. When the folded main antenna reaches the installation site it will be deployed or assembled from a folded or dismantled position. Due to transportation difficulties and/or during the deployment and/or assembly some defects or imperfections in the physical and/or electrical characteristics of the main antenna may be caused or revealed. In many of those cases, such when the deployment is taking place in a rural location or in space, on-site correction, rectification or ordering of replacement antenna reflector may be almost impossible, if not completely impossible. As a result performance of the defected antenna may be degraded compared to the planned performance, causing lower antenna gain, lower transmission/receipt bandwidth, etc.

A system and method according to embodiments of the present invention may allow compensating of the main reflector defects and imperfections by adapting and/or manipulating the shape of the reflecting surface of the sub-reflector, such as sub-reflector 102. This may allow the restoration of the antenna performance to substantially those of anon-defected antenna and continuing the use of the main reflector even with its defects and imperfections.

Figure 2A:
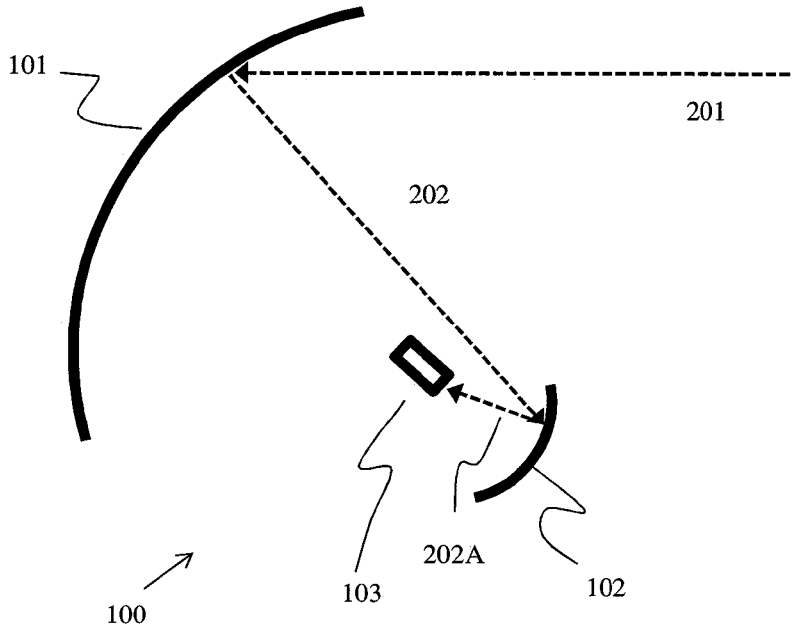
FIG. 2A illustrates propagation paths of transmission waves hitting the elements of antenna system.

An antenna having perfectly shaped main antenna reflector (i.e. non-defected) with properly shaped sub-reflector and correctly located sub-reflector and feed, a transmission hitting the main antenna reflector from the expected direction will be reflected towards the sub-reflector and from it to the feed, for every transmission line hitting the main antenna reflector from the right direction (also denoted the right inbound transmission direction). Reference is made to FIG. 2A, which illustrates propagation paths of transmission waves hitting the elements of antenna system 100. Antenna system 100 comprises main reflector 101, sub-reflector 102 and feed unit 103. As described above, main reflector 101 may be formed as a perfect parabolic reflector adapted to concentrate incoming transmission lines, such as line 201 that hit main reflector 101 parallel to each other, toward sub-reflector 102. Sub-reflector 102 may be formed as a spatial concaved reflector adapted to concentrate transmission lines coming from main reflector 101, such as transmission line 202, towards feed 103, located at a transmission focus point, thus adapted to receive substantially all of the transmission energy hitting main reflector 101.

Figure 2B:
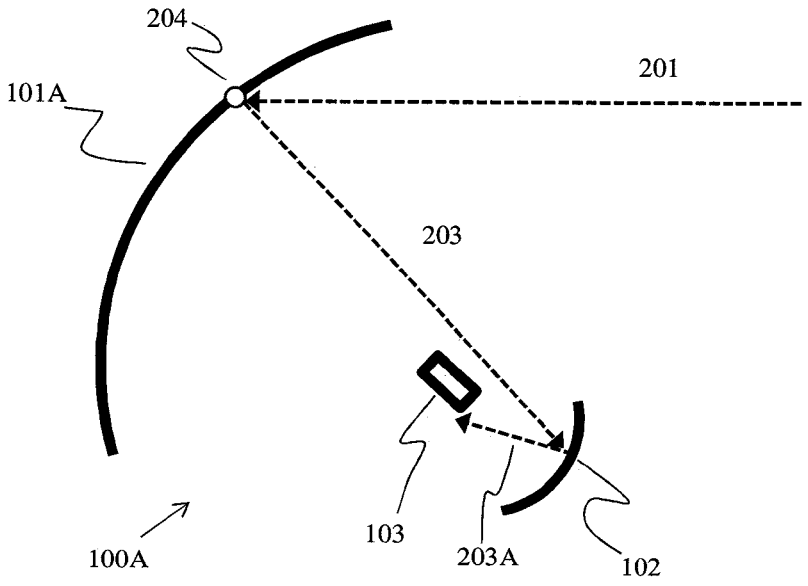
FIG. 2B schematically depicts performance of antenna assembly where the main reflector is not formed as a perfect parabolic reflector.

Reference is made now to FIG. 2B, which schematically depicts performance of antenna assembly 100A where main reflector 101A is not formed as a perfect parabolic (or other perfectly shaped reflector), with form or mechanical defects and imperfections. As seen, transmission line 201 that hits main reflector 101A at point 204 where the reflector has defect, reflects transmission line 203 toward sub-reflector 102, similar to sub-reflector 102 of FIG. 2A. However, due to the imperfection at point 204 reflected transmission line hits sub-reflector 102 so that its reflection transmission line 203A toward feed 103 is deviated from the desired direction and as a result some or all of its energy may miss feed 103. Generally, defects and imperfections on main reflector 103 may be expressed, when antenna assembly 100A receives transmissions, in reduced total transmission energy at the feed, in cross-talk that reduces bandwidth, in cross-polarization that reduces transmission energy and bandwidth, and the like.

As described above, main reflector of an antenna assembly, such as main reflector 101, may suffer of mechanical defects, deforms and other mechanical configuration imperfections due to transport impacts or on-site deployment from a folded position. Imperfections of a main reflector may also occur due to sharp and large temperature changes the reflector is subjected to, for example when deployed in space, due to being impinged by space dust or small rocks or due to hits from space craft's debris. Maintenance of such main reflector after deployment may be very hard or completely impossible.

The total performance of antenna assembly, such as antenna assembly 100 or 100A, may be handled to compensate for main reflector imperfections, according to embodiments of the present invention, by manipulating the specific concave shape of the sub-reflector, e.g. sub-reflector 102. Imperfections of the main reflector may be located, measured, assumed or evaluated in various ways. For example the main reflector of an antenna assembly may be measured after production for finding and mapping deviation of its curvature from the planned curvature, for example by measuring the curvature of the produced main reflector and documenting locations of deviation and the nature of the deviation. According to another embodiment, expected imperfections of a main reflector that is made to be folded, transported to the installation location and then be deployed, may be folded, subjected to transportation typical damages and then be deployed, where all of these operations may take place locally where the main reflector is manufactured. In case where the antenna assembly is made to be deployed, for example, in outer space, the main reflector may be deployed in a facility simulating very low air pressure and even zero gravity. After the main reflector has been deployed its imperfections may be evaluated and/or measured. For example, a map of deviation of the reflector shape from the required shape may be drawn. Such map of imperfections may be recorded and stored digitally. The map may include locations on the main reflector where deviations were found, and the nature of the deviation. According to some embodiments, this digitally stored map of imperfections (deviations of the concave of the reflector from its desired form) may be defined as Reflector Imperfections Map (RIM). According to some embodiments, based on the data of the RIM, required changes in the form of the concave of the sub-reflector may be calculated, so that the total performance of the antenna assembly, as measured at the feed in case of incoming transmission, will be as close as possible to an antenna assembly having un-defected main reflector. Such performance may be achieved when the maximal gain of the antenna assembly for the received transmission, is as close as possible to the gain that would have been received by the antenna assembly having a perfectly shaped main reflector.

This requirement may be achieved, according to embodiments of the present invention, by deforming the concave shape of the sub-reflector so as to direct as much of the transmission power towards the feed unit, with as less as possible out-of-phase received transmission and/or as less as possible cross-polarization received transmission at the feed unit. Antenna assembly, which comprise at least one sub-reflector that is adapted to change its curvature according to, for example, required corrections to deforms in the main reflector may be denoted adaptive antenna system.

Figure 2C:
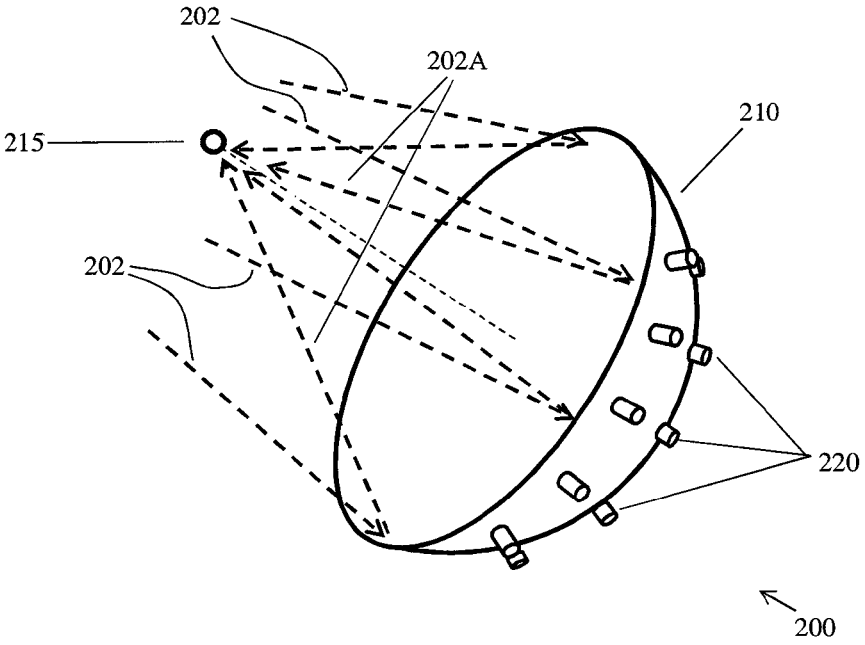
FIG. 2C is a schematic perspective view of sub-reflector system adapted to dynamically change the curvature of its reflector, according to embodiments of the present invention.

Reference is made now to FIG. 2C, which is a schematic perspective view of sub-reflector system 200 adapted to dynamically change the curvature of its reflector, according to embodiments of the present invention. Sub-reflector 200 may be part of an antenna assembly, such as antenna assembly 100 (FIGS. 2A and 2B) and may be used for tuning the performance of an antenna assembly, as is described herein after. Sub-reflector system 200 may comprise sub-reflector unit 201 having a calculated focal point 215 and a plurality of actuators (or manipulation elements) 220 attached on the outer face (the convex face) of sub-reflector system 200 and adapted to locally deform the curvature of the reflector by moving the material forming the face of the sub-reflector into the inner side (the side of the focal point 215) or out. Actuators 220 may be any suitable linear actuators capable of locally deforming the curvature of sub-reflector 210 to the direction and distance required. Typically actuators 220 may comprise an electric motor and mechanical transmission converting the rotation of the motor into linear movement. It would be apparent to those skilled in the art that other means known in the art may be used for this purpose. Such means need to be able to receive control signal and perform a corresponding mechanical movement that will locally deform the curvature of the sub-reflector to the right amount.

Figure 2D:
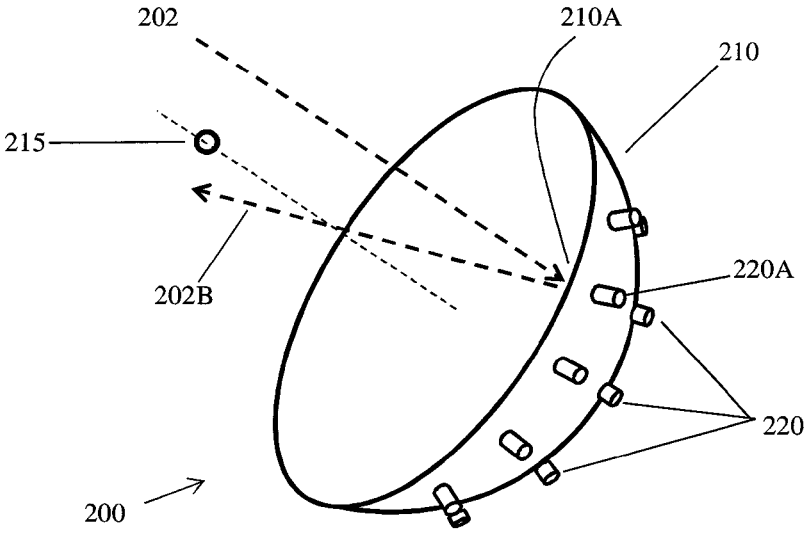
FIG. 2D schematically illustrates the way a sub-reflector system of FIG. 2C locally influences the direction of reflection, according to embodiments of the present invention.

Reference is made now to FIG. 2D, schematically illustrating the way sub-reflector system 200 of FIG. 2C locally influences the direction of reflection, according to embodiments of the present invention. Transmission line 202, coming, for example, from a main reflector (such as main reflector 101 or 101A), hits sub-reflector 210 at location 210A, which is located against and made to be locally deformed by the movement of actuator 220A. In the example of FIG. 2D the movement of actuator 220A caused a local deformation that caused reflected transmission line 202B of coming transmission line 202 to be directed somewhat away from focal point 215 of sub-reflector system 200.

Reference is made now to FIG. 2E which schematically illustrates deployment of a set of actuators on the backside of sub-reflector 200, and to FIGS. 2F and 2G which schematically illustrate the operation of an actuator for causing local deformation effecting a corresponding deformation area around actuator 220A defined within border line 220B, according to embodiments of the present invention. FIG. 2E presents a scheme of deployment of actuators 220 on the backside of sub-reflector 210A of sub-reflector system 200. Actuators 220 may be deployed, according to the example of FIG. 2E, in several concentric arrangements, on locations on the concentric lines corresponding to radials passing through the center point of sub-reflector 210 and spaced in even angles, 22.5 degrees in this example.

FIG. 2F schematically illustrates a cross section in sub-reflector 210 along line 210A of FIG. 2E and the influence of the operation of actuator 220A on the curvature of sub-reflector 210. Actuator 220A is located on the center circle and on radial 210A of the deployment scheme of actuators 220, according to the example of FIG. 2E. Activation of actuator 220A may deform locally the curvature of sub-reflector 210 as described by lines $\mathbf{210}_{CH1}$ and $\mathbf{210}_{CH2}$, schematically illustrate the maximal inside and outside local deformation applicable by actuator 210A.

A bundle of transmission lines 202, for example as reflected from main reflector such as main reflector 102A, may hit location 210A on the concave surface of sub-reflector 210. The curvature of sub-reflector 210 may be deformed by the activation of actuator 220A. When actuator 220A is activated to locally push the surface of sub-reflector inwardly, as schematically depicted by line, $\mathbf{210}_{CH1}$, the reflected transmission lines 202C may form a local dispersing bundle due to the local convex form of the surface of sub-reflector 210. When actuator 220A is activated to locally pull the surface of sub-reflector inwardly, as schematically depicted by line $\mathbf{210}_{CH2}$, the reflected transmission lines 202B may form a local converging bundle focusing locally at local focus point 215A, due to the local concave form of the surface of sub-reflector 210.

FIG. 2G schematically describes the geometric dimensions of applicable local deformations of actuator 220A, according to embodiments of the present invention. Actuator 220A may be attached at point 210A (see also in FIG. 2D) to the outer face of sub-reflector 210 and may be adapted to deform locally the surface of sub-reflector 210 by locally pushing the material forming sub-reflector 210 inwardly or outwardly as described by lines $\mathbf{210}_{CH1}$ and $\mathbf{210}_{CH2}$, designating the maximal inward and outward local changes, respectively. The range of local change in-and-out is denoted 220AD and the corresponding deformation area is defined by the border line 220B. It will be appreciated that in order to enable local deformation as described above, sub-reflector 210 may be made of one or more of various materials using a variety of technics that will enable an attached actuator to locally deform the surface of the sub-reflector to the desired magnitude of deformation 220AD in a direction perpendicular to the face of the reflector at this point, while maintaining the affected area within the range of 220B. For example, a sub-reflector may have radius which is the range of 5%-20% of the radius of the respective main reflector. The sub-reflector may be made of a thin conductive (e.g. made of metal) mesh having holes smaller than 10% of the operational wavelength coated by, or embedded in flexible non-conductive sheet (such as plastic sheet), or a thin conductive sheet (e.g. made of metal) coated by flexible non-conductive sheet (such as plastic sheet), the conductive thin sheet may have made in it thin cuts to allow the required flexibility for initially receiving the concave form and for allowing the required local changes exerted by actuator 220. The effective travel range 210AD of an actuator 220A may have the magnitude of ±2 cm and the affected area 220B may a radius of 5 cm or, in other embodiments, a radius of twice the distance between two neighboring actuators. The distance between two neighboring actuators is dictated by the wavelength, the size of the main reflector and by parameters of the specific embodiment.

In some embodiments of the invention, an adaptive antenna system may comprise several elements, for example a main reflector, such as reflector 100, or an array of reflectors; a feed assembly comprising a feed element, such as feed unit 103 or an array of feed elements 103 and a sub-reflector, such as sub-reflector 102/200 or an array of sub-reflectors 102/200. The system may further comprise computing device or devices and optionally feedback device or devices. Such a system may be deployed in its designated location and the feedback device may be deployed at the remote location that the antenna is targeting to illuminate or is directed to receive transmissions from. The system's sub-reflector may further be adapted to be manipulated in order to adjust the illumination on or from the main reflector, for example as described above.

Correction of Main Reflector Deforms Without Remote Feedback Devices

An adaptive antenna system may be deployed, installed and operated in remote locations or in locations the access to the adaptive antenna system there is very hard, expensive or otherwise non-profitable or impossible, such as satellite antenna deployed in space, a remote automatic transmission station located in a location with hard access, etc. An adaptive antenna system may have, according to some embodiments, at least one transmission channel with an operator, a person in charge, a computing facility accessible by a corresponding expert, and the like.

Figure 3A:
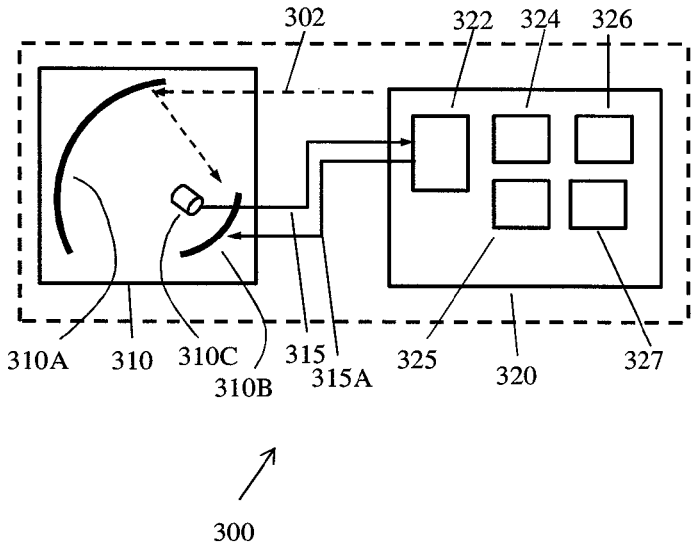
FIGS. 3A and 3B schematically illustrate adaptive antenna system without operational/control communication channel remotely and with such communication channel, respectively, according to embodiments of the present invention.
Figure 3B:
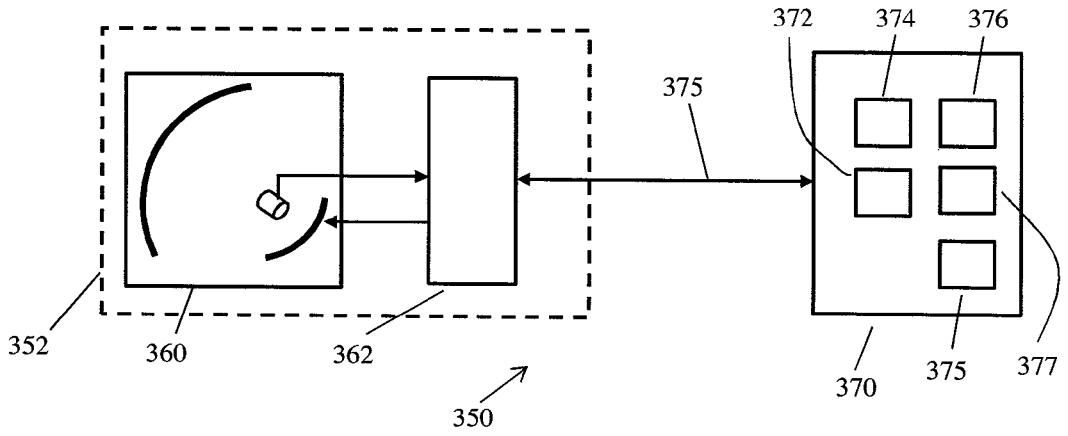

Reference is made now to FIGS. 3A and 3B, which schematically illustrate adaptive antenna system without operational/control communication channel remotely and with such communication channel, respectively, according to embodiments of the present invention. Adaptive antenna system 300 of FIG. 3A comprise antenna system 310, local computing unit 320 and communication channel 315 to enable sending signals received in antenna system 310 to computing unit 320 or, when in transmission mode, to send transmit signals from computing unit 320 to antenna system 310. When in receive mode antenna system 310 may receive transmission 302 and signals carried with this transmission may be collected at feed unit 310C. sub-reflector 310B of antenna system 310 may be same as, or similar to sub-reflector system 200 of FIGS. 2D-2G, with an array of actuators adapted to receive control signals and to locally deform the surface of sub-reflector 310B. The actuators of sub-reflector 310B of antenna system 310 are not shown in order to not obscure the drawing, yet it should be apparent that their operation and their effect on the performance of sub-reflector 310B are as described with regard to sub-reflector 200 and its actuators 220 with respect to FIGS. 2D-2G above. The actuators of sub-reflector 310B will be denoted herein 310$B_{ACT}$.

Computing unit 320 may include a controller 324 that may be, for example, a central processing unit processor (CPU), a chip or any suitable computing or computational device, an operating system 325, a memory 326, an executable code stored in the memory, non-transitory storage 327, and input/output devices 322. Controller 324 may be configured to carry out methods described herein, and/or to execute or act as the various modules, units, etc. More than one computing device 320 may be included in a system according to embodiments of the invention, and one or more computing devices 320 may act as the various components of a system. For example, by the executing executable code stored in memory 326, controller 324 may be configured to carry out a method of correcting deforms or defects in a main antenna of antenna system 310.

Operating system 325 may be or may include any code segment (e.g., one similar to the executable code described above) designed and/or configured to perform tasks involving coordination, scheduling, arbitration, supervising, controlling or otherwise managing operation of computing unit 320, for example, scheduling execution of software programs or enabling software programs or other modules or units to communicate. Operating system 325 may be a commercial operating system, a proprietary operating system or a combination thereof.

Memory 326 may be or may include, for example, a Random Access Memory (RAM), a read only memory (ROM), a Dynamic RAM (DRAM), a Synchronous DRAM (SD-RAM), a double data rate (DDR) memory chip, a Flash memory, a volatile memory, a non-volatile memory, a cache memory, a buffer, a short term memory unit, a long term memory unit, or other suitable memory units or storage units. Memory 120 may be or may include a plurality of, possibly different memory units. Memory 120 may be a computer or processor non-transitory readable medium, or a computer non-transitory storage medium, e.g., a RAM.

The executable code may be any executable code, e.g., an application, a program, a process, task or script. The executable code may be executed by controller 324 possibly under control of operating system 325. For example, the executable code may be an application that manages a process for compensating for defects in main antenna of antenna system 310, as described herein. A system according to embodiments of the invention may include a plurality of executable code segments similar to the executable code described above, that may be loaded into memory 326 and cause controller 324 to carry out methods described herein.

According to embodiments of the present invention, transmission 302 received by antenna system 310 may be collected at the feed unit 310C and signals carried by this transmission may be provided to computing unit 320 via communication channel 315. The signals in transmission 302 may carry, according to some embodiments, data indicative of the power of transmission at the transmitting station. When such data is transmitted it may be extracted and stored in computing unit 320. In other cases such data may not be included in the transmission. When no data indicative of the power of transmission at the transmitting station is transmitted a process based only on the power of the received signals at the feed 310C will be performed by computing unit 320. Assuming transmission 320 having fixed transmission power is received at antenna system 310 and the collected signal at feed 310C is communicated to computing unit 320.

Absent any information indicative of the total performance of antenna system 310 other than the power of signals received at feed 310C, computing device 320 may perform the following process. When signals are received at feed 310C and communicated to computing unit 320 the power of the signals $SIG_{P0}$ is recorded. In the next step a first actuator 310$B_{ACT1}$ from the array of actuators 310$B_{ACT}$ is selected computing system 320 sends control signal to slightly change locally the curvature of sub-reflector 310B. The change may be as small as 1/N where N is the number of discrete steps that may be performed by an actuator from actuators array 310$B_{ACT}$. In some embodiments the value of such step may be 220AD/N, and it should comply with the general requirement of 1/100 of the operational wavelength. In some embodiments the value of N may be in the range of 50-500. According to some embodiments the initial direction of this change (in or out bound) and its magnitude may be selected randomly. In other embodiments these values may be calculated based on previous such processes and the effect changes made during these previous processes made. In other embodiments these values may be calculated based on the Reflector Imperfections Map (RIM) information that may be pre-stored in the memory unit or storage unit of computing unit 320.

The change in the power of the signal received at feed 310C is recorded and another change is performed by actuator 310$B_{ACT1}$ and its effect on the power of the received signal is again recorded. This process may be repeated until a maximum of the received power, denoted $P_{MAX1}$, is achieved. The position of actuator 310$B_{ACT1}$ is recorded and associated with the value $P_{MAX1}$.

This process may be repeated for all actuators 310$B_{ACTm}$ for values 1<m<M, where M is the number actuators. Once this process terminates and terminal values $P_{MAXm}$ for 1<m<M are recorded, this set of values is denoted updated max-of-max (UMOM) for antenna system 310. It will be noted that the actual order of actuators, whether selected one-by-one along an outer circle then restarting with an inner circle (herein denoted circular-from-out-to-center), or beginning from the center outwardly (herein denoted circular-from-center-out), or beginning along a radial line from out to center and then picking a neighbor radial (herein denoted radial-from-out-to-center) or vise versa (denoted radial-center-to-out), or any other scheme—such scheme will be stored with the associated resulting received signal power. Accordingly, the performance of each of the schemes may be compared and the scheme that yields maximum received power may be selected.

When scheme of activation of actuators 310$B_{ACTm}$ is calculated or selected several considerations may be brought in. one such consideration is the effect of out-of-phase transmission lines.

When the transmission wavelength is in the millimetric range or less, a dent deformation of the main reflector having depth or protrusion in the order of magnitude of one millimeter or less, the transmission line reflected from this defected area of the main antenna may be received at the feed out-of-phase with regard to the majority of received transmission lines reflected, for example, from non-defected locations on the main reflector, subsequently causing reduction of the total received power of the signal.

In another example, transmission lines reflected from defected locations on the main reflector may cause cross-polarization to some of the transmission lines received at the feed of the antenna system, subsequently causing also reduction of the total received power of the signal.

In some other example both phenomena may occur concurrently thus reducing the total received power of the signal at the feed even further.

Planning and/or performing of the above described process for arriving at the UMOM values may take into consideration the effect of out-of-phase and cross-polarization phenomena in order to receive better results, by searching for minimum value of each, denoted herein $MIN_{OOP}$ and $MIN_{CP}$ respectively.

According to some embodiments the computations associated with extraction of indication of defects and imperfections in the main reflector from signals received from the antenna assembly, and providing control signals to the actuators to compensate for such defects may be done remotely from the location where the antenna assembly is deployed. Reference is made to FIG. 3B, which schematically presents antenna installation 352 comprising antenna assembly 360, which is similar to antenna assembly 310 and communication adaptor 362, adapted forward signals from the feed of antenna assembly 360 to remote computing unit 370 and to receive signals from remote computing unit 370 and forward them to the actuators of the sub-reflector of antenna assembly 360. Computing unit 370 may comprise, similarly to computing unit 320, controller 374, operating system 375, memory 376, executable code stored in the memory or in storage 377 and in/out device 372. Communication channel 375 provides for communication to and from computing unit 370. Computing unit 370 may be located as remotely as needed from antenna installation 352. For example, antenna installation may be deployed in space while computing unit 370 may be located on the earth. Such arrangement may be beneficial for maintenance and operation of computing unit 370 easily, while in an arrangement of FIG. 3A such maintenance is not easy if the deployment is in space.

Figure 4A:
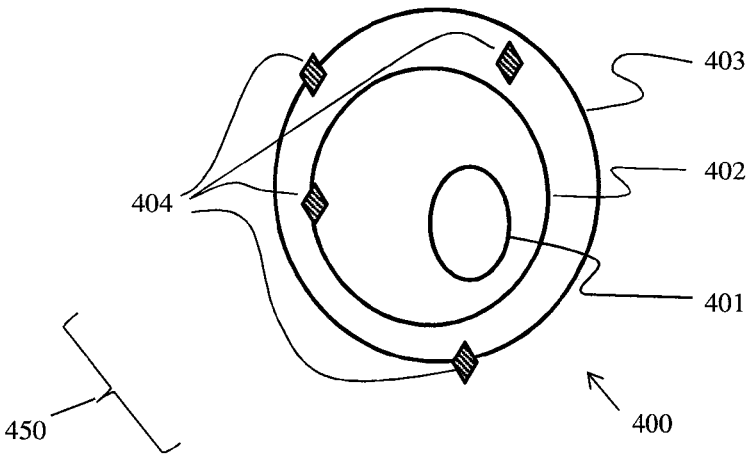
FIG. 4A schematically presents an example of a footprint of antenna illumination on a target area, according to embodiments of the present invention.

Correction of Main Reflector Deforms and Forming Desired Footprint with Remote Feedback Devices In order to ensure that a remotely deployed antenna illuminates a desired footprint, for example on the earth, and/or in order to locate defects and imperfections in the main reflector feedback devices may be deployed in the target area. Several on or more feedback devices may be utilized. Reference is made to FIG. 4A, which schematically presents an example of footprint 400 of antenna illumination on a target area 450, according to embodiments of the present invention. The radiation footprint of an antenna, such as antenna 310 or 360, may be presented by iso-radiation strength lines 401, 402 and 403. Line 401 may represent, for example, the geometric location of points where the radiation of the antenna is of a first strength, for example 60 dBw. Similarly line 402 may represent the geometric location of points where the radiation of the antenna is of a second strength, for example 58 dBw and line 403 may represent the geometric location of points where the radiation of the antenna is of a third strength, for example 56 dBw. Several feedback devices or radiation sensors 404 may be placed in the target area 400. Selection of the location of placement of sensors 404 may be done so as to meet the required information expected to be extracted from the sensors. Generally the number and deployment scheme of sensors 404 will be done to provide the maximal information for a selected target. In the example of FIG. 4A the location of sensors 404 may more accurately describe the footprint of the antenna at its 58 dBw and 56 dBw strength lines. Information extracted from sensors 404 may be compiled into a map of antenna actual performance (AAP) in the target area 450.

According to some embodiments, such map AAP may be used for mapping the actual performance of an antenna that has defects in its main reflector, in order to calibrate the total performance of the antenna assembly base on its actual performance as measured its target area.

In a calibration process according to some embodiments, the remotely deployed antenna may be instructed to illuminate (transmit) the target area, the feedback devices 404 may measure the received transmission power and this information may be compiled into a local AAP. This mapping may be compared to a calculated footprint of a non-defected antenna located where the measured antenna is and illuminating the target area 450. Form this comparison the location and nature of defects in the main reflector of the measured antenna may be calculated. The comparison may be done in a computing unit located at the remote antenna, or in a computing unit located remotely from the antenna. These calculations may be translated into correction vector that will be communicated to the actuators of the sub-reflector of the measured antenna. In further embodiments, several illumination footprint characteristics may be measured and recorded for further use. The system's computing device may receive the radiation footprint information and may further calculate, determine and locate the defected sectors in the main reflector using, for example, the Fourier series and transform and Nyquist-Shannon sampling theorem.

According to further embodiments measured illumination footprint of an antenna may be used for shaping the form of the footprint. Shaping of a footprint to deviate from the footprint naturally formed by the illuminating antenna may be desired, for example, in order to make sure that the transmission energy is not directed to locations where there are no users requiring the transmission of the antenna, or in order to limit the transmission to places where authorized users are located and prevent this transmission from non-authorized users located in other places.

Figure 4B:
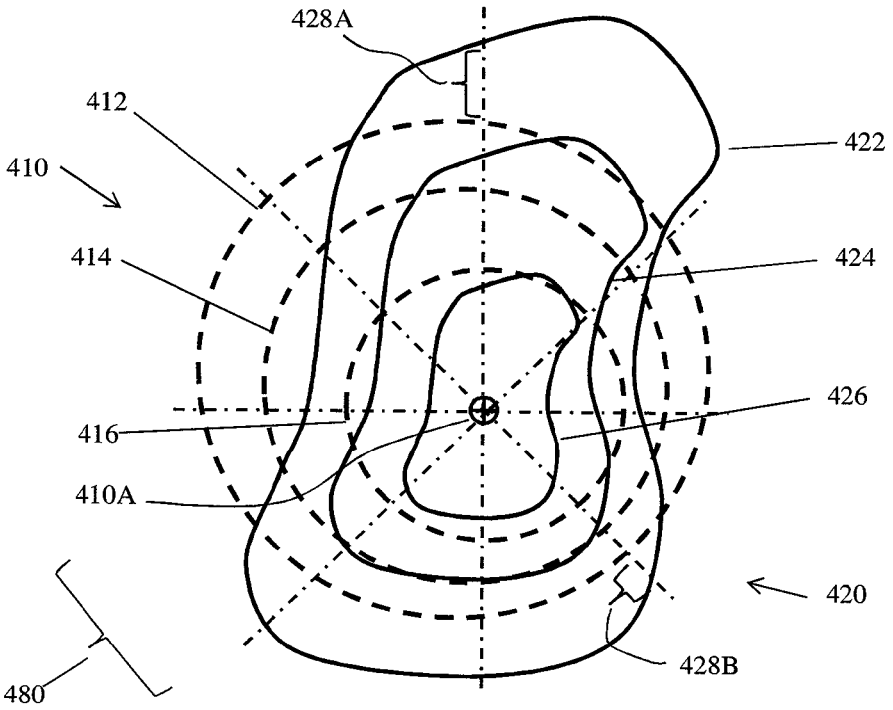
FIG. 4B schematically presents a non-modified footprint and a modified footprint of antenna assembly, according to embodiments of the present invention.

Reference is made now to FIG. 4B, which schematically presents non-modified footprint 410 and modified footprint 420, according to embodiments of the present invention. Footprint 410 may comprise documented three iso-radiation-strength lines 416, 414 and 412, where the following apply: $Power_{416}>Power_{414}>Power_{412}$. When the desired modified foot print is footprint 420, where $Power_{426}>Power_{424}>Power_{422}$, the deviation of the desired footprint from the actual footprint may be translated into a vector of change instructions to be communicated to the actuators of the antenna assembly. For example, the target area 480 may be partitioned into sectors around a central point 410A of the actual footprint and the deviation of the desired footprint from the actual footprint may be expressed by a set of geographic/angular deviation as measured along radials extending from central point 410A. For example, along radial extending 'northbound' deviation 428A depicts the local difference between actual footprint line 412 and desired footprint line 422, and along radial extending 'south-east bound' deviation 428B depicts the local difference between actual footprint line 412 and desired footprint line 422. This way a set of deviation values may be calculated and then be used to produce modification vector of values for changing the position of some or all of the actuators of the sub-reflector of the antenna assembly, in order to modify the footprint from the actual to the desired footprint.

Figure 4C:
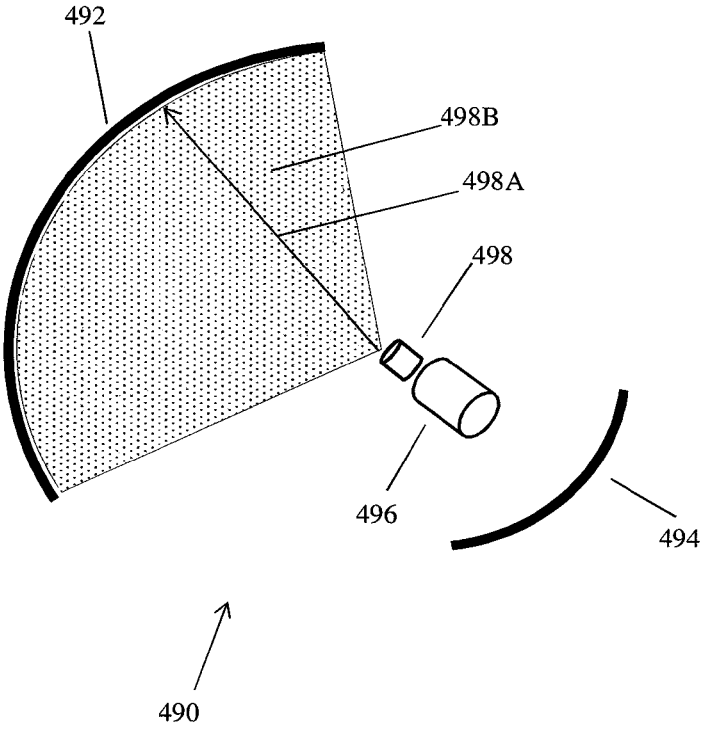
FIG. 4C schematically presents antenna assembly with a range detector device for mapping actual curvature of a main reflector, according to embodiments of the present invention.

Correction of Main Reflector Deforms Based on Geometric Measurements of the Main Reflector Defects and imperfections of a main reflector of an antenna assembly deployed remotely may be measured on-site using geometric measuring device capable of measuring the form of the main reflector of the antenna assembly. Reference is made now to FIG. 4C which schematically presents antenna assembly 490 comprising main reflector 492, sub-reflector 494 and feed 496, similar or equal to antenna assembly 100A (FIG. 2B) with sub-reflector characteristics similar to those of sub-reflector 200 (FIGS. 2D-2G). Antenna assembly 490 further comprises geometric measuring device 498, which is capable of measuring at least the distance to any selected point on the inner face of main reflector 492 from measuring device 498. Measuring device 498 may be configured to scan a selected area of the concave surface of main reflector 492, manually (i.e. in response to instructions received from outside of antenna assembly 490) or automatically (i.e. according to scanning scheme and scanning instructions stored and/or calculated locally at antenna assembly 490). The selected area may be partial or equal to the inner surface of main reflector 492. Scanning the surface of main reflector 492 and measuring the distances of the scanned points may yield a set of data items representing the geometrics of the inner face of the main reflector. Measuring of the actual form of the main reflector may be done, for example, by measuring device 498 comprising a LASER range detector adapted to be aimed at desired directions and receive the distance of the point on aimed by the LASER range detector from the detector. The LASER range detector may be located at a point from which a line of sight exists to all points to be measured, for example next to/behind feed 496. The range detection may be done point-by-point using a direction-controlled narrow-beam range detector having a line of sight 498A that may be directed within spatial sector 498B that substantially covers all area of interest of main reflector 492. At the end of the scanning process the form of the inner face of the main reflector is mapped with respect to the distance of each mapped point from a reference point (e.g. device 498). Based on this information defects and imperfections of the main reflector may be detected and calculated. At this stage a correction vector may be calculated comprising movement values for some or all of the actuators of the sub-reflector, as explained above.

According to yet further embodiments, actuators of a sub-reflector, such as subreflector 200 of FIGS. 2D-2G, may be activated to null or at least substantially minimize undesired effect of interfering broadcast reaching the antenna assembly, for example when broadcast from the ground is received by an antenna located in space. The nature/characteristics of the interfering broadcast may be detected and the actuators may be activated so that the amount of power of the interfering broadcast does not reach the feed or at least its power is substantially minimized. The scheme of operation of the actuators may be any, and for example one of the schemes discussed above with respect to FIGS. 3A-3B.

Tuning Performance Parameters of Antenna Assembly

Figure 4D:
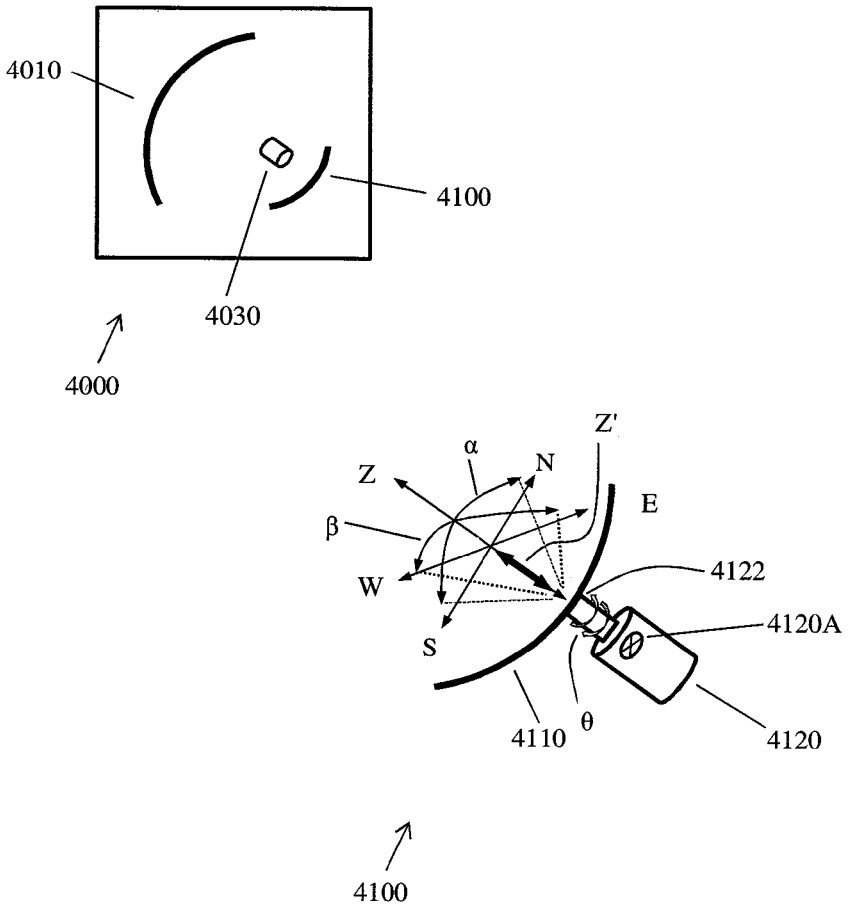
FIG. 4D schematically presents an antenna assembly capable of being remotely tuned for changing performance parameters, according to embodiments of the present invention.

According to embodiments of the present invention performance parameters of an antenna assembly may be tuned or re-tuned to achieve certain changes of the antenna assembly performance. Reference is made now to FIG. 4D. which schematically presents antenna assembly 4000 capable of being remotely tuned for changing performance parameters. Antenna assembly 4000 comprises main reflector 4010, sub-reflector 4100 and feed 4030. Sub-reflector 4100 may comprise actuator 4120 connected to the sub-reflector's antenna 4110. Actuator 4120 is adapted to manipulate reflector 4110 by changing its orientation and/or location with respect to a reference frame. Actuator 4120 may be adapted to respond to corresponding control signals in order to rotate reflector 4110 about dual-axis pivot point 4120A in a yaw movement along reference axis S-N in an angle of change $\alpha$, and pitch movement along reference axis E-W, perpendicular to reference axis N-S in an angle $\beta$. Actuator 4120 may further be adapted to move reflector 4110 along reference axis Z in along operational movement range Z'. Actuator 4120 may further be adapted to rotate reflector 4110 about rotation axis 4122 in an angle $\theta$. According to embodiments of the present invention actuator 4120 may be controlled to change the position and/or orientation of reflector 4110 with respect a reference frame in one or more of the changes listed above. Regardless of defects in any one of main reflector 4010 and/or sub-reflector assembly 4100, at any given static position of antenna assembly 4000, the performance of antenna assembly 4000 with transmissions in a given wavelength may be changed merely be activating actuator 4120 to change the location or orientation of sub-reflector 4110 in one or more of its degrees of freedom. In one embodiment the location of sub-reflector 4110 may be changed along the Z axis (moving the sub-reflector closer to or away from main reflector 4010). Assuming that prior to the activation of this change antenna assembly 4000 was focused with respect to transmissions to (or from) a certain target area in a given wavelength, movement of sub-reflector 4110 may cause defocusing of antenna assembly 4000. Defocusing of transmissions from a remote antenna assembly may be useful and desired when it is required to expand the coverage area of the antenna assembly, possibly on the expense of reduced bandwidth. In other embodiment it may be required to shift the coverage area (i.e. change the direction of illumination) of the antenna assembly. This may be achieved by changing the orientation of sub-reflector 4110 about at least one of its gimbal axes N-S and E-W. slight changes about gimbal axes N-S and E-W may yield, in another embodiment, changes in the antenna assembly gain, due to correction of defect in main antenna 4010 resulting from the change of orientation of sub-reflector 4100.

Figure 5:
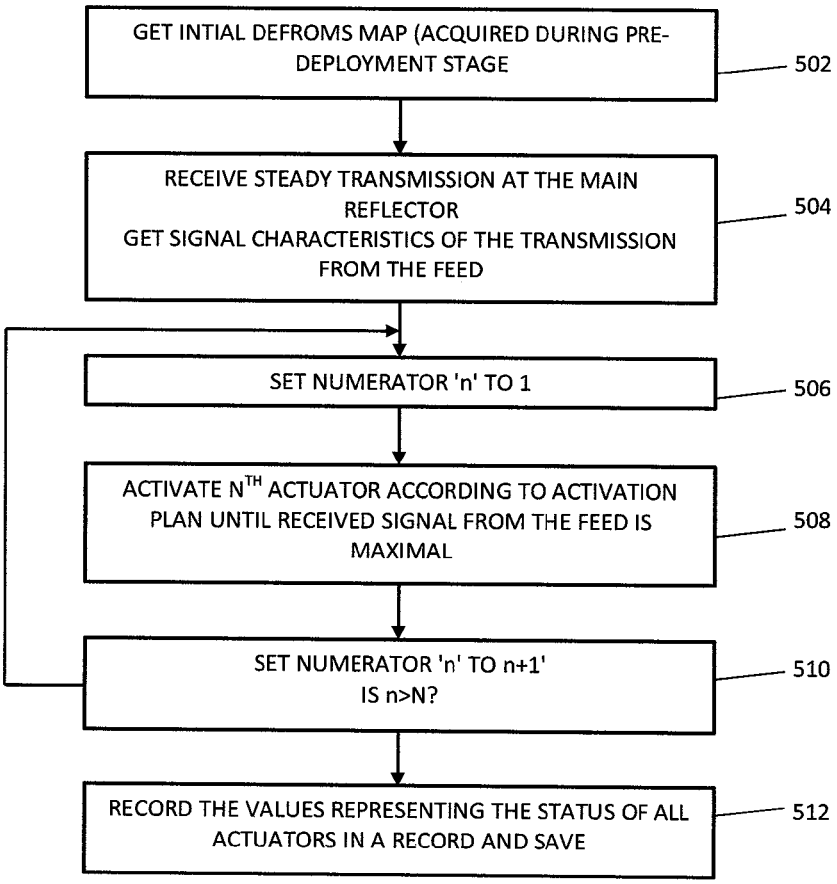
FIG. 5 is a flow diagram presenting steps of manipulating actuators of a sub-reflector to compensate for deforms of a main reflector based on received signals at the antenna, according to embodiments of the invention.

A process for compensating main reflector deforms by way of changing the position of actuators of a sub-reflector according to a certain scheme may comprise the following stages, as depicted in FIG. 5, which is a flow diagram presenting steps of manipulating actuators of a sub-reflector to compensate for deforms of a main reflector based on received signals at the antenna, according to embodiments of the invention. In block 502 initial deforms scheme, as measured after production in before deployment of the antenna may be received. Steady transmission to the antenna is provided and the signal at the feed is characterized and recorded (block 504). For a repetitive process a numerator n is set to 1 (block 506). The nth actuator is activated to locally deform the surface of the sub-reflector until the received signal is maximized, and the actuator is left at that position (block 608). The process numerator is advanced by one (block 510) and the process repeats until all N actuators are activated according to this process. After all involved actuators are set, the status of the actuators is recorded in a chart representing the changes made in the sub-reflector to compensate for defects in the main reflector.

Figure 6:
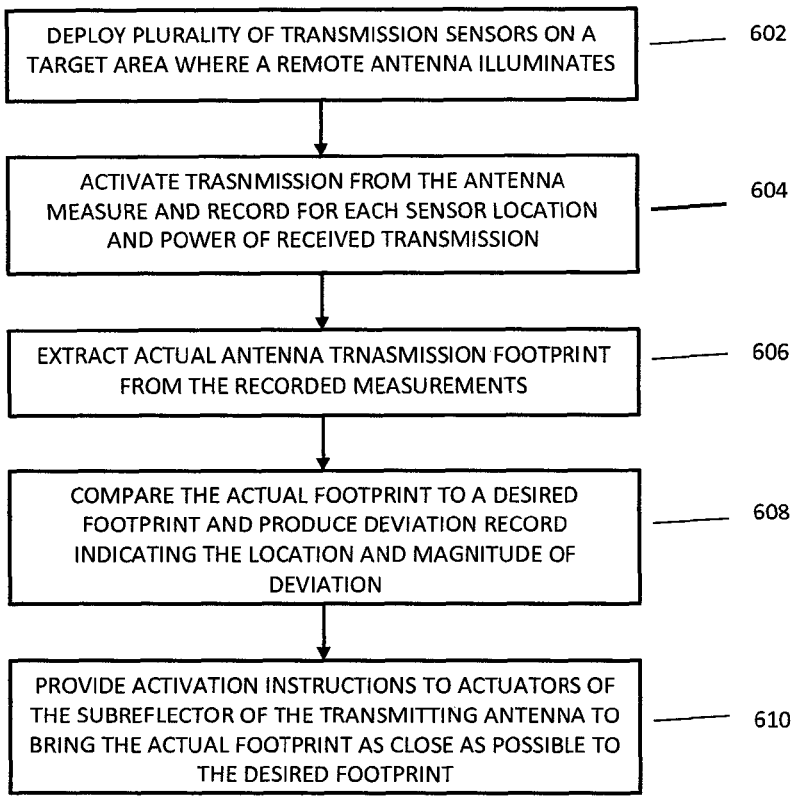
FIG. 6 is a flow diagram presenting steps of manipulating actuators of a sub-reflector, according to embodiments of the invention.

A process for compensating main reflector deforms or for forming a desired antenna illumination footprint based on received transmission sensors on the ground, may comprise the following stages, as depicted in FIG. 6, which is a flow diagram presenting steps of manipulating actuators of a sub-reflector, according to embodiments of the invention. A plurality of transmission sensors is deployed over the transmission illumination target area (block 602). Transmission from the remote antenna assembly is activated, and the received transmission power at each of the deployed sensors is recorded (block 604). Actual antenna performance and actual footprint are extracted based on the measurements of the transmission sensors (block 606). The actual footprint is compared to a desired footprint and a deviation record is calculated (block 608). Based on the record of calculated deviation values and their locations activation instructions are provided to the actuators of the sub-reflector, so as to bring the actual footprint as close as possible to a desired footprint (block 610). It should be noted that the desired footprint may be, according to an embodiment, the footprint that would have been illuminated by a non-defected main reflector, yet, according to another embodiment the desired footprint may be a footprint with special form.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. An antenna assembly tunable from remote comprising:
a main reflector,
a sub-reflector associated with the main reflector,
a feed adapted to receive transmission illuminating the main reflector via the sub-reflector, or to transmit transmission to the main reflector via the sub-reflector, and
a geometric measuring device including a LASER range detector for scanning an inner face of the main reflector by measuring a distance to a plurality of selected points on the inner face of the main reflector from the LASER range detector and to yield a set of data items representing the geometrics of the inner face of the main reflector, said LASER range detector located next to the feed where a line of sight exists to all points to be measured;
wherein the sub-reflector comprising:
a plurality of actuators disposed over and attached to its outer face, each of the plurality of actuators being adapted using a control unit to locally deform a surface of the sub-reflector adjacent to the respective actuator in response to a first change in the respective actuator position, and each of the plurality of actuators being adapted using the control unit to locally deform the surface of the sub-reflector adjacent to the respective actuator by locally pushing a material outwardly in response to a second change in the respective actuator position, and
the sub-reflector is made of a conductive mesh having holes smaller than 10% of an operational wavelength of the antenna assembly, wherein the conductive mesh is embedded in a flexible non-conductive sheet.

2. The antenna assembly of claim 1 wherein the plurality of actuators are disposed spaced over a selected area of the outer face of the sub-reflector.

3. The antenna assembly of claim 1, wherein each of the plurality of actuators is configured to change its position in response to a control signal.

4. The antenna assembly of claim 3, wherein the control unit further comprising:
a controller;
a memory unit;
a non-transitory storage unit; and
an input/output unit.

5. The antenna assembly of claim 4, wherein the LASER range detector is used to store values of the distance in the non-transitory storage unit.

6. The antenna assembly of claim 1, wherein the plurality of actuators comprise a single actuator that is adapted to move the sub-reflector about a pivot point in angular movement in at least one of two perpendicular planes.

7. The antenna assembly of claim 6, wherein the single actuator is further adapted to move the sub-reflector along a linear axis coinciding with the line of crossing of the two perpendicular planes closer to or farther from the main reflector.

8. The antenna assembly of claim 7, wherein the single actuator is further adapted to rotate the sub-reflector about the linear axis.

9. A sub-reflector for use in an antenna assembly comprising:
a plurality of actuators disposed over and attached to the sub-reflector's outer face, each of the plurality of actuators being adapted to locally deform a surface of the sub-reflector adjacent to the respective actuator by locally pushing a material forming the sub-reflector inwardly or outwardly in response to a change in the respective actuator position;
a geometric measuring device including a LASER range detector for scanning an inner face of a main reflector by measuring a distance to a plurality of selected points on the inner face of the main reflector from the LASER range detector and to yield a set of data items representing the geometrics of the inner face of the main reflector, said LASER range detector located next to a feed where a line of sight exists to all points to be measured; and
a control unit adapted to control the position of each of the plurality of the actuators;
wherein the sub-reflector is made of a conductive mesh having holes smaller than 10% of an operational wavelength of the antenna assembly, the conductive mesh being embedded in a flexible non-conductive sheet.

10. The sub-reflector of claim 9 wherein the plurality of actuators are disposed over a selected area of the outer face of the sub-reflector.

11. The sub-reflector of claim 9, wherein the control unit comprising:
a controller;
a memory unit;
a non-transitory storage unit; and
an input/output unit.

12. The sub-reflector of claim 11, wherein the non-transitory storage unit has stored thereon software program that when executed by the controller, causes the input/output unit to provide control signals to the plurality of actuators.

13. The sub-reflector of claim 12, further comprising a Reflector Imperfections Map (RIM) stored in the non-transitory storage unit.

* * * * *